US007076960B2

(12) United States Patent
Takemasa

(10) Patent No.: US 7,076,960 B2
(45) Date of Patent: Jul. 18, 2006

(54) PRESERVING SYSTEM

(75) Inventor: Kazuo Takemasa, Osaka-fu (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 10/602,515

(22) Filed: Jun. 24, 2003

(65) Prior Publication Data

US 2004/0000151 A1 Jan. 1, 2004

(30) Foreign Application Priority Data

Jun. 28, 2002 (JP) ..... 2002-188991

(51) Int. Cl.
*F25B 9/00* (2006.01)

(52) U.S. Cl. ..... 62/6; 62/47.1

(58) Field of Classification Search ..... 62/6, 62/45.1, 51.1, 119, 606, 49.2
See application file for complete search history.

(56) References Cited

U.S. PATENT DOCUMENTS 3,433,028 A * 3/1969 Klee ..... 62/50.7
4,135,548 A * 1/1979 Sears ..... 137/392
4,592,205 A * 6/1986 Brodbeck et al. ..... 62/49.2
4,824,454 A * 4/1989 Kondo et al. ..... 62/6
5,195,577 A * 3/1993 Kameda et al. ..... 165/104.13
5,293,750 A * 3/1994 Tamura et al. ..... 62/47.1
5,327,729 A * 7/1994 Yanai et al. ..... 62/606

FOREIGN PATENT DOCUMENTS

JP 10-243951 9/1998

* cited by examiner

*Primary Examiner*—William Doerrler
*Assistant Examiner*—Michael J. Early
(74) *Attorney, Agent, or Firm*—Weingarten, Schurgin, Gagnebin & Lebovici LLP

(57) ABSTRACT

To provide a preserving system capable of re-using vaporized nitrogen, and moreover, capable of always cooling the specimens at a predetermined temperature or lower. The preserving system comprising a cylinder and the preserving vessel which is supplied with liquid nitrogen from this cylinder, is provided with a Stirling refrigerator and a condensing chamber arranged outside of said preserving vessel, and the gas phase part of this condensing chamber is made to communicate with that of said preserving vessel and also the liquid phase part is made to communicate with that of said preserving vessel, and further the cooling part of said Stirling refrigerator is arranged in said condensing chamber, therefore, the nitrogen vaporized in the preserving vessel is cooled by the cooling part of the Stirling refrigerator in the condensing chamber and liquefied again, and so this liquid nitrogen can be reused for cooling the preserving vessel. Moreover, since the preserving vessel can be cooled by the liquid nitrogen when performing maintenance on the Stirling refrigerator, the specimens in the preserving vessel can always be cooled at a predetermined temperature or lower.

1 Claim, 2 Drawing Sheets

PRESERVING SYSTEM

BACKGROUND OF THE INVENTION

1. Field of the Invention

This invention relates to a preserving system for cryopreserving biological preservation specimens such as frozen cells, tissue cells, sperms, ova for a long term.

2. Detailed Description of the Prior Art

A preserving system using liquid nitrogen ($LN_2$) has ever been disclosed by the Japanese Patent Laid-Open No. 1998-243951.

In the preserving system described in the Japanese Patent Publication, preservation specimens (for example, the biological specimens) were cryopreserved in a liquid nitrogen cylinder by soaking them therein.

When liquid nitrogen is used, it vaporizes at −189° C. so the temperature can be lowered close to −189° C. As a result, the biological specimens and so on can be cryopreserved for a long time.

Moreover, a preserving system of the same kind as the above is known, which is provided with a preserving vessel to be supplied with liquid nitrogen and a cylinder for supplying the liquid nitrogen to this preserving vessel. As for the preserving system, such a system as the liquid nitrogen in the preserving vessel vaporizes is also known, automatically fed when it decreases to a predetermined quantity or below by vaporizing.

In the preserving system, the cryopreservation temperature is maintained by the latent heat of vaporization of the liquid nitrogen and thus the vaporized nitrogen is left as it is without being collected, therefore, the drawbacks of the system is a large consumption of liquid nitrogen and a high economical burden.

Moreover, as described above, in the system arranged so as to be automatically replenished with a vaporized amount from the liquid nitrogen cylinder, the cylinder has to be regularly replenished with liquid nitrogen, and once the replenishment is neglected, the temperature of the specimens preserved in the preserving vessel rises, and in a worst case, the specimens become extinct. Therefore, the replenishment of liquid nitrogen has been a large troublesome job (a drawback) for a custodian.

Therefore, it has been desired to compensate for the above-mentioned two drawbacks and develop a preserving system capable of securing the safety of specimens to be preserved.

SUMMARY OF THE INVENTION

The present invention has an object to solve such conventional drawbacks and to provide a preserving system that can reuse vaporized nitrogen and as well as can always cool the specimens at a predetermined temperature or lower.

According to the present invention, a preserving system comprises a cylinder filled with liquid nitrogen and a preserving vessel, for preserving by cooling biological specimens preserved therein, supplied with the liquid nitrogen from the cylinder, in which the system comprises a Stirling refrigerator or a refrigerator using Gihord-MacMahon cycle and a condensing chamber arranged outside the preserving vessel, and the gas phase part of the condensing chamber is made to communicate with that of the preserving vessel, the liquid phase part of the condensing chamber is made to communicate with that of the preserving vessel, and the cooling part of the refrigerator is arranged inside the condensing chamber.

Moreover, a pressure sensor is arranged in the condensing chamber, and the refrigerator is driven when a detection value of the sensor is a predetermined value or higher than that.

Further, the liquid phase part of the condensing chamber is set to a position higher than that of the liquid phase part of said preserving vessel.

Furthermore, the condensing chamber is provided with a gas discharge path communicating with each other between the inside and the outside of the condensing chamber, and the gas discharge path is provided with a safety valve for opening the gas discharge path when the pressure in the condensing chamber rises up to a dangerous value of the pressure or higher than that.

BRIEF DESCRIPTION OF THE DRAWINGS

These and others and advantages of the present invention will become clear from following description with reference to the accompanying drawing, wherein.

EXPLANATION OF REFERENCE NUMERALS

Figure 1:
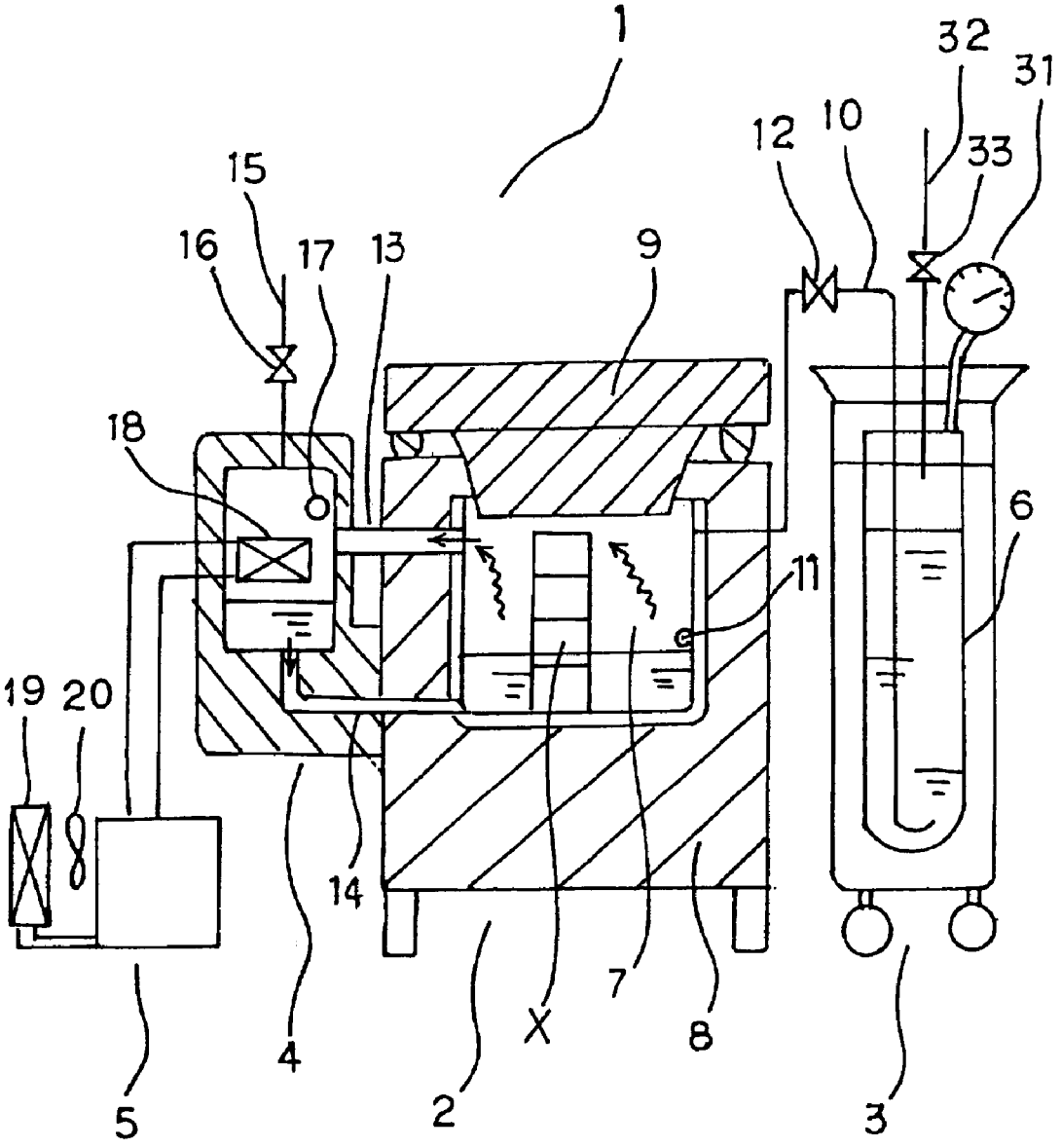
FIG. 1 is an explanatory drawing illustrating the preserving system of the present invention.

1 Preserving system
2 Preserving vessel
4 Condensing chamber
5 Stirling refrigerator
6 Cylinder
13 Pipe
14 Pipe
15 Gas discharge path (gas discharge passage)
16 Safety valve
17 Pressure sensor
18 Cooling part
X Biological specimens

DETAILED DESCRIPTION OF THE PREFERRED EMBODIMENT

While the presently preferred embodiment of the present invention has been shown and described, it will be understood that the present invention is not limited thereto, and that various changes and modification may be made by those skilled in the art without departing from the scope of the invention as set forth in the appended claims.

Embodiments of the present invention will be explained below based on the drawings.

FIG. 1 is an explanatory drawing of the preserving system in accordance with the present invention, and a preserving system 1 cools biological preservation specimens X (for example, frozen cells, tissue cells, sperms, ova, or the like) at a temperature of −180° C. or lower and preserves them for a long term.

The preserving system 1 is mainly constituted of a preserving vessel 2 with a metallic vessel made of thermally insulated stainless steel, an $LN_2$ container 3, a condensing chamber 4, and a Stirling refrigerator 5.

In the $LN_2$ container 3, a cylinder 6 filled with liquid nitrogen is installed.

Moreover, the reference number 31 is a pressure gauge for indicating the pressure of the cylinder 6, and the reference number 32 is a gas discharge path, the reference number 33 is a safety valve to be opened at the time of an abnormal high pressure.

The preserving vessel 2 is constituted of a main body 8 of the preserving vessel provided with a preservation chamber 7 in which the preservation specimens X are preserved at a temperature of −180° C. or lower, and a cover 9. Plenty of thermal insulating materials are used for the main body 8 and the cover 9 so that heat can hardly flow in therein from outside.

A liquid nitrogen supply pipe 10 extending from the cylinder 6 is connected with the preservation chamber 7, and a liquid level sensor 11 is arranged therein. When the liquid level sensor 11 detects the fall in the liquid level of the liquid nitrogen, an on/off valve (a solenoid valve) 12 in the supply pipe 10 is automatically opened to supply with the liquid nitrogen via the supply pipe 10.

The reference number 13 is a pipe communicating between the upper gas part of the condensing chamber 4 and the upper gas part of the preserving vessel 2; the numeral 14 is a pipe for connecting between the lower liquid phase part of the condensing chamber 4 and the lower liquid phase part of the preserving vessel; the numeral 15 is a gas discharge pipe (gas discharge path) for connecting between the inside and outside of the condensing chamber 4, the numeral 16 is a safety valve arranged in the gas discharge pipe, and when the condensing chamber 4 is pressurized at a dangerous pressure or higher, namely, when a pressure sensor 17 detects the abnormally high dangerous pressure, the safety valve opens the passage of the gas discharge pipe 15 interlocking with the sensor 17.

The Stirling refrigerator 5 uses helium gas an operating medium, and a cooling part 18 working as the vaporizing part is cooled down to −200° C. or lower. Since the cooling part 18 is arranged in the condensing chamber 4, vaporized nitrogen can be condensed in the condensing chamber 4. Here, the cooling part 18 may be located directly or indirectly in the condensing chamber 4 so that heat is conducted.

Moreover, the numeral 19 is a heat release part of the Stirling refrigerator 5, and the numeral 20 is a blower.

The preserving system 1 thus constructed operates as explained below.

When the liquid level of the liquid nitrogen in the preservation chamber 7 becomes lower than a predetermined level, the on/off valve 12 interlocked with the liquid level sensor 11 is opened and the liquid level of the liquid nitrogen is controlled at the position where the liquid level sensor 11 is installed.

The liquid nitrogen in the preservation chamber 7 takes away the heat from the specimens to vaporize and cryopreserves these specimens to be at −180° C. or lower. Then, a part of the vaporized nitprogen flows also into the condensing chamber 4 via the pipe 13.

Figure 2:
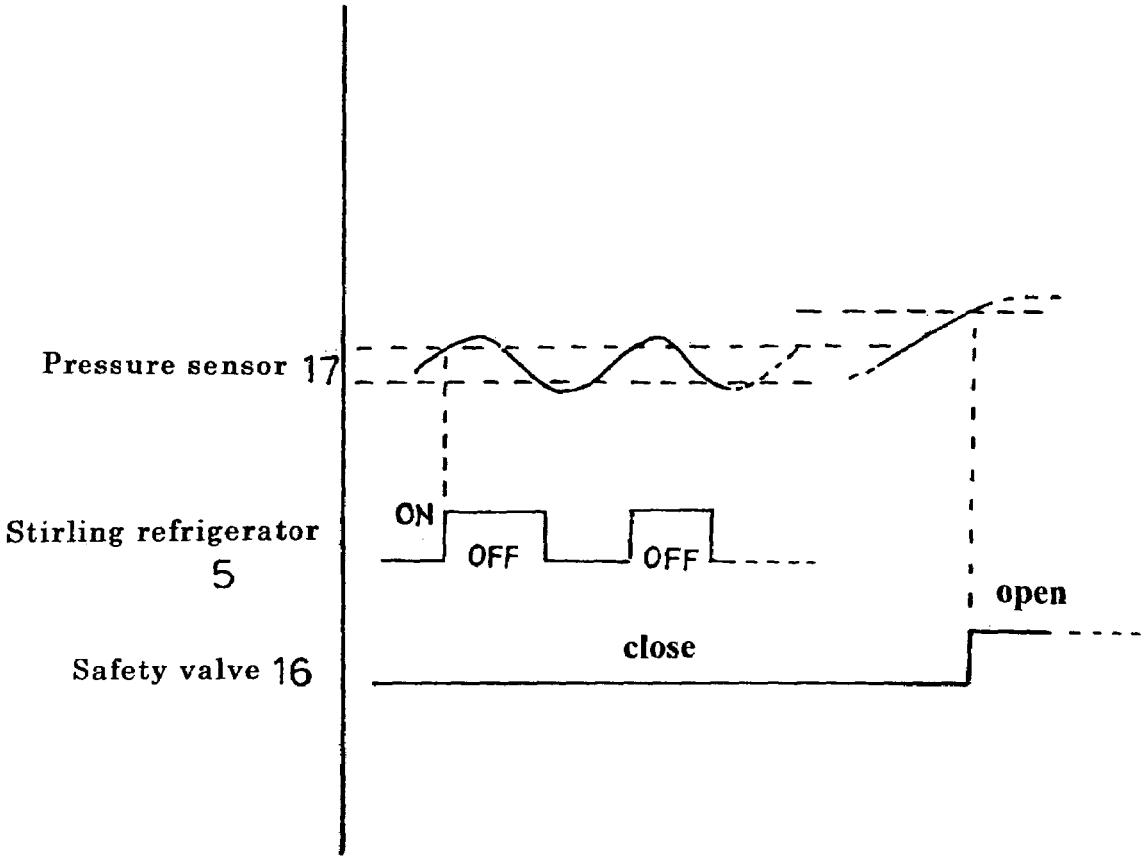
FIG. 2 is an explanatory drawing illustrating the operation of the preserving system.

The pressure in the condensing chamber 4 gradually rises up, as the vaporized nitrogen flows into the condensing chamber 4, and the pressure sensor 17 detects the pressure, and when the sensor detects a predetermined pressure or higher, the Stirling refrigerator 5 is driven (refer to FIG. 2). When the Stirling refrigerator 5 is driven, the nitrogen gas is cooled down by the cooling part 18 and is partly liquefied. Since the liquid phase part of the condensing chamber 4 is arranged at a position higher than the liquid phase part of the preservation chamber 7, the nitrogen liquefied in the condensing chamber 4 naturally returns to the liquid phase part of the preservation chamber 7 through the pipe 14 by empty-weight.

Thus, the nitrogen gas which has conventionally been discharged out of the preservation chamber 2 spontaneously and has not been considered to be collected or reused, is liquefied again by the cooling part 18 of the Stirling refrigerator 5 and reused, therefore, a consumption amount of the liquid nitrogen can be reduced, and the running costs of the preserving system 1 can be made inexpensive.

Moreover, since the consumption amount of liquid nitrogen can be reduced, the frequency of the job for re-filling with nitrogen into the cylinder and that for exchanging the cylinder can be reduced, and a lot of work is decreased in a case of using the preserving system 1.

Moreover, since the liquid phase part of the condensing chamber 4 is arranged at a position higher than the liquid phase part of the preservation chamber 7, the liquid nitrogen can be returned to the liquid phase part of the preservation chamber 7 by the empty-weight without necessitating a driving source such as a pump and it makes the arrangement inexpensive.

As a very rare case, it is considered that the pressure of the condensing chamber 4 may abnormally rise when using the preserving system 1. In this case, the pressure sensor 17 detects the abnormal pressure and the safety valve 16 interlocked with this sensor 17 is opened (refer to FIG. 2), and the pressure in the condensing chamber 4 can be maintained at a predetermined value or below. Here, the preserving system 1 may be arranged so as to notify it by an indicator and alarm sound that the abnormal pressure rise has occurred when this safety valve 16 is opened.

Moreover, the Stirling refrigerator 5 requires maintenance work at several month intervals (for example, every 3 to 6 months) in which the accumulated waxy lubricating oil in the refrigerating circuit needs to be regularly removed (Maintenance work is necessary also for a GM refrigerator which will be described later).

When the maintenance work is performed, the specimens X can be refrigerated with the liquid nitrogen from the nitrogen cylinder 6 so as not to exceed −180° C., therefore, the specimens X can be prevented from rising in temperature. Of course, it is necessary to confirm that necessary nitrogen is contained in the cylinder 6 before starting the maintenance work.

Thus, using the preserving system 1, the specimens X can be cooled and cryopreserved while suppressing consumption of the nitrogen by re-condensing the vaporized nitrogen when the Stirling refrigerator 5 can be driven, except when the maintenance work is performed. When the Stirling refrigerator 5 cannot be driven at the time of performing the maintenance work, the specimens X can be cooled and cryopreserved by supplying the liquid nitrogen as in the conventional way, therefore, the specimens can be always cooled at −180° C. or lower without a break by using the nitrogen cylinder 6 and the Stirling refrigerator 5.

As a result, the specimens can be prevented as much as possible from being deteriorated in preservation quality due to a temporary rise in temperature.

For example, it is known that conventionally, as a result of the examinations of sperms and fertilized eggs in the livestock industry when they are preserved once, and then re-defrosted and examined, the preservation temperatures cause a difference in a survival rate of the fertilized eggs of the defrosted cells between those preserved at the temperatures of −80° C. to −150° C. and those preserved at the temperatures of −180° C. or lower. Moreover, when those fertilized eggs that have been preserved at −180° C. or lower are temporarily raised in temperature to −80° C. to −150° C., the result is the same as that of those preserved at temperatures between −80° C. and −150° C. It is unknown what really causes this. However, increasing demand for such preserving vessels to be used at −180° C. or lower is expected in order to preserve ES cells (Embryonic Stem Cells) or the like in the biotechnology. The preserving system in accordance with the present invention is suitable for the cells that need to be cryopreserved always at −180° C. or lower as the above.

Moreover, in the preferred embodiment, the preserving system has been explained referring to an example using a Stirling refrigerator, however, any refrigerator capable of condensing vaporized nitrogen can be used, for example, a refrigerator using Gihord-MacMahon cycle (GM refrigerator) may be used.

As explained above, according to the invention, the preserving system comprises a cylinder filled with liquid nitrogen and a preserving vessel, for preserving by cooling biological specimens preserved therein, supplied with the liquid nitrogen from the cylinder, in which the system comprises a Stirling refrigerator or a refrigerator using Gihord-MacMahon cycle and a condensing chamber arranged outside the preserving vessel, and the gas phase part of the condensing chamber is made to communicate with that of the preserving vessel, the liquid phase part of the condensing chamber is made to communicate with that of the preserving vessel, and the cooling part of the refrigerator is arranged inside the condensing chamber. Therefore, the nitrogen vaporized in the preserving vessel is cooled by the cooling part of the Stirling refrigerator in the condensing chamber and liquefied again, and so this liquid nitrogen can be reused for cooling the preserving vessel. Moreover, since the preserving vessel can be cooled by the liquid nitrogen when performing maintenance on the refrigerator, the specimens in the preserving vessel can always be cooled at a predetermined temperature or lower.

Moreover, according to the invention, the pressure sensor is arranged in the condensing chamber, and the refrigerator is driven when a detection value of the sensor is a predetermined value or higher than that. Therefore, when the pressure rises to the predetermined value or higher and the vaporized nitrogen needs to be condensed, the refrigerator can be driven, and as a result, the preserving vessel can be cooled with small driving energy.

Further, according to the invention, the liquid phase part of the condensing chamber is set to a position higher than that of the liquid phase part of the preserving vessel. Therefore, the condensed and liquid nitrogen can be returned to the preserving vessel naturally by the self-weight without necessity of using a pump, and this arrangement allows the preserving system to be inexpensive.

Moreover, according to the invention, the condensing chamber is provided with a gas discharge path communicating with each other between the inside and the outside of the condensing chamber, and the gas discharge path is provided with a safety valve for opening the gas discharge path when the pressure in the condensing chamber rises up to a dangerous value of the pressure or higher than that. Therefore, the condensing chamber can be prevented as much as possible from being damaged, by controlling the condensing chamber pressure so that it does not reach a dangerous pressure.

While the presently preferred embodiment of the present invention has been shown and described, it will be understood that the present invention is not limited thereto, and that various changes and modification may be made by those skilled in the art without departing from the scope of the invention as set forth in the appended claims.

What is claimed is:

1. A preserving system, the system comprising a cylinder filled with liquid nitrogen and a preserving vessel, for preserving by cooling biological specimens preserved therein, supplied with the liquid nitrogen from said cylinder at the starting stage, wherein the cylinder can be refilled with liquid nitrogen or exchangeable with another cylinder filled with liquid nitrogen, wherein said system comprises a Stirling refrigerator or a refrigerator using Gihord-MacMahon cycle and a condensing chamber arranged outside said preserving vessel, and the gas phase part of the condensing chamber is made to communicate with that of said preserving vessel, the liquid phase part of the condensing chamber is made to communicate with that of said preserving vessel through a pipe connecting between the lower part of the condensing chamber and the lower part of a preservation chamber of said preserving vessel, said pipe entirely disposed below an upper surface of the liquid phase part of said preserving vessel, and wherein the liquid phase part of the condensing chamber is set to a position higher than that of the liquid phase part of said preserving vessel, and the cooling part of the refrigerator is arranged inside the condensing chamber, and further a valve associated with a liquid supply pipe from said cylinder to said preservation chamber of said preserving vessel, a liquid level sensor arranged in said preservation chamber, wherein the valve is opened to supply said liquid nitrogen from said cylinder to said preservation chamber when a liquid level of said liquid nitrogen in said preservation chamber detected by said liquid level sensor becomes lower than a predetermined level, and a pressure sensor arranged in said condensing chamber, said refrigerator being driven when a detection value of said pressure sensor is a predetermined value or higher than that, and further wherein said condensing chamber is provided with a gas discharge path communicating with each other between the inside and the outside of the condensing chamber, and the gas discharge path is provided with a safety valve for opening the gas discharge path when the pressure in the condensing chamber rises up to a dangerous value of the pressure or higher than that.

* * * * *